US006032909A

United States Patent [19]

Kröner

[11] Patent Number: 6,032,909

[45] Date of Patent: Mar. 7, 2000

[54] BRACKET AWNING SUPPORT

[75] Inventor: Sven Kröner, Mettingen, Germany

[73] Assignee: Schmitz-Werke GmbH + Co., Emsdetten, Germany

[21] Appl. No.: 08/863,012

[22] Filed: May 23, 1997

[30] Foreign Application Priority Data

May 24, 1996 [DE] Germany ..... 296 09 318 U

[51] Int. Cl.[7] ..... A47H 1/10

[52] U.S. Cl. ..... 248/273

[58] Field of Search ..... 248/273, 291.1, 248/299.1; 160/66, 67, 70, 22

[56] References Cited

U.S. PATENT DOCUMENTS

| | | | |
|---|---|---|---|
| 2,373,574 | 4/1945 | Larson | 160/77 |
| 2,752,992 | 7/1956 | D'Azzo | 160/46 |
| 4,641,805 | 2/1987 | Martensson, IV | 248/273 |
| 4,673,017 | 6/1987 | Lauzier | 160/66 |
| 5,423,506 | 6/1995 | Spoon | 248/273 |

FOREIGN PATENT DOCUMENTS

| | | |
|---|---|---|
| 19 60 466 | 3/1967 | Germany . |
| 75 02 964 | 8/1975 | Germany . |

*Primary Examiner*—Derek J. Berger
*Assistant Examiner*—David Heisey
*Attorney, Agent, or Firm*—Browdy and Neimark

[57] ABSTRACT

In a joint-arm awning comprising an arrangement for the adjustment or setting of the angle of inclination, the joints alms being disposed on a support pipe which can be mounted on the wall by way of fastening brackets, it is provided, with a view to obtaining a constructionally simple solution requiring only a low number of components, that the arrangement for the setting of the angle of inclination is disposed on the fastening brackets in such a way that the angle of inclination of the support pipe is adjustable in relation to the fastening brackets.

7 Claims, 1 Drawing Sheet

BRACKET AWNING SUPPORT

BACKGROUND OF THE INVENTION

1. Field of the Invention

The invention relates to a joint-arm awning comprising an arrangement for the adjustment or setting of the angle of inclination, the joint alms being disposed on a support bar which can be mounted on the wall by way of fastening brackets.

2. Background Art

In order to set the angle of inclination of the joint aims relative to the ground or relative to the wall on which the fastening brackets are mounted, provision is conventionally made for an arrangement for the setting of the angle of inclination which ensures the inclination of the awning alms to be modified relative to the support pipe, the support pipe being tightly united with the fastening brackets. This solution is rather complicated constructionally.

Box-mounted awnings are known to have the entire box pivotable relative to the wall, however these solutions are comparatively expensive.

SUMMARY OF THE INVENTION

It is the object of the invention to embody a joint-arm awning, in particular a joint-arm awning of open design, in such a way that adjustment of the angle of inclination is easy to realize in terms of construction, requiring only a low number of components.

In accordance with the invention, this object is attained by the brackets being provided with an arrangement for the setting of the angle of inclination in such a way that the inclination of the support bar is adjustable in relation to the brackets.

As a result of this embodiment, there is no need for an adjusting arrangement for each joint arm; rather, the inclination of the entire support bar and the joint aims tightly united with the latter can be adjusted so that the relations between the joint arms and the support bar remain constant regardless of the angle of inclination set.

By advantage, it is provided that the support bar has holders which, in the form of a bow, grip over a holding section of the fastening brackets. In particular, the holding section is hooked so that the entire awning is simply suspended for mounting.

The holding section of the fastening brackets is curved so that the space required by the holding section in the recess of the support bar holder varies, depending on the inclination of the bow-shaped support bar holders; consequently, owing to the curvature of the holding section, a certain angle of inclination is defined virtually by the varying space required.

For an angle of inclination thus set to be fixed, it is advantageously provided that the support bar can be braced relative to the holding section, its inside, to this end, resting on the holding section so that the support bar can be actuated from outside by screws and braced relative to the holding section.

For the definite fixing of an angle of inclination thus set, it can be provided that the holding section comprises a threaded hole for a stop screw which contacts the bottom of the U formed by the bow-shaped support bar holder.

Further, provision can be made for the holding section of the fastening brackets to be dimensioned such that its diameter decreases toward its free outer end in a direction approximately perpendicular to the fastening section. This design ensures that suspending the awning for assembly is facilitated.

Details of the invention will become apparent from the ensuing description of a preferred embodiment, taken in conjunction with the drawing.

DESCRIPTION OF THE PREFERRED EMBODIMENT

Figure 4:
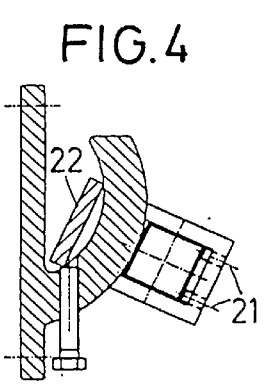
FIG. 4 is a sectional view corresponding to FIG. 2.

An awning 1 seen in the drawing comprises a support bar 2 on which bearings 3 are mounted for a fabric shaft 4 (or, roll shaft 4). Further, two joint arms (or, support arms) 5 extend away from the support bar 2, the joints arms 5 having an inner jointarm section 6 and an outer joint-arm section 7 abutted as shown to the latter; the outer joint-arm section 7 is further articulated to a drop-out pipe 8 to which the outer end of the availing fabric 10 is fixed by way of a piping groove 9. The inner joint-arm section 6 is mounted on the support bar 2 by way of an arm bracket 10.

Two bow-shaped support-pipe holders 12 serve for fixing the support bar 2 and thus the entire awning 1 to a wall 11, the support-pipe holders 12 being mounted on fastening brackets 13 as specified in detail below.

As seen in the drawing, the bowshape of the support-pipe holders 12 includes a U-shape.

Each fastening bracket 13 comprises a plate-type fastening section 14 which is screwed on the wall 11 by means of screws 15. A hooked holding section 16 extends away from the fastening section 14 and is bent as seen in particular in FIGS. 3 and 4, first arching outwardly and then again standing back inwardly, i.e. curving arcuately. The holding section or holding member 16 has a threaded hole 17 for a stop screw 18 to be screwed in, traversing the holding section 16 from below.

Figure 6:
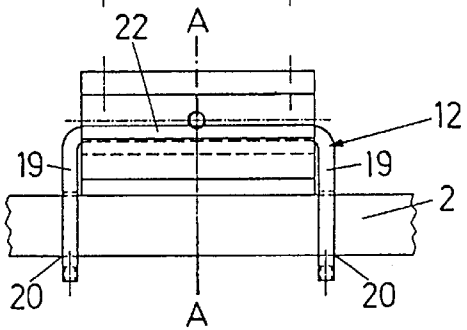
FIG. 6 is a plan view of the fastening bracket.

Each support-bar holder 12 is configured as a bow in the form of a U, as seen in particular in FIG. 6. The legs 19 of the U of the support-bar holder 12 each have a recess 20, the height of which corresponds to the height of the support bar 2 and through which passes the support bar 2, the recesses 20 being open toward the inside so that the support bar 2 is displaceable in this direction and can be braced i.e. clamped against the holding section 16 of the bracket 13 by means of two straining screws 21.

Figure 3:
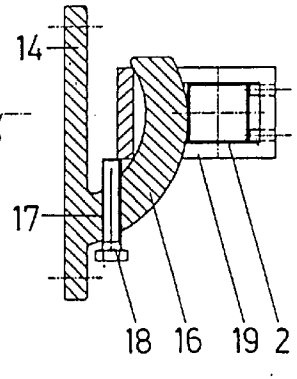
FIG. 3 is atonal view corresponding to FIG. 1 on the line A—A of FIG. 6.
Figure 5:
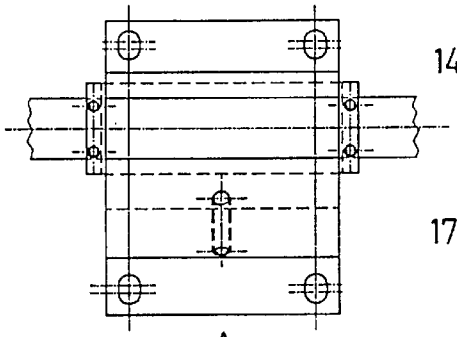
FIG. 5 is an elevation view of a fastening bracket.

The support-bar holders 12 are dimensioned such that a recess remains between the bottom 22 of the U formed holders 12 and the support bar 2 guided within the legs 19 of the U in such a way that the holding section 16 of the fastening brackets 13 can reach into this recess, as seen in particular in FIGS. 3 and 4. It is possible simply to suspend the entire awning on the fastening brackets 13, which considerably simplifies the mounting job or, respectively, the commencement of the mounting job.

Figure 1:
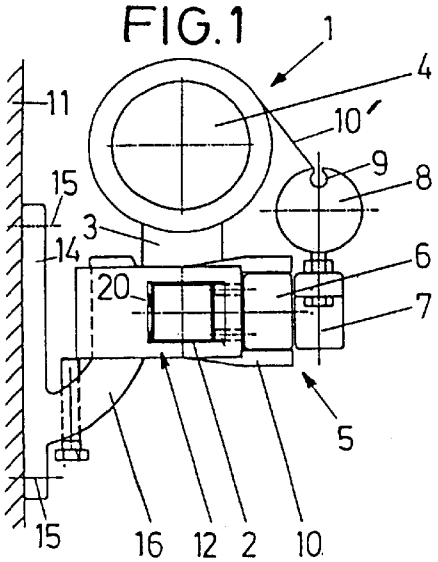
FIG. 1 is a latatral view of a joint-arm awning according to the invention in the retracted condition.
Figure 2:
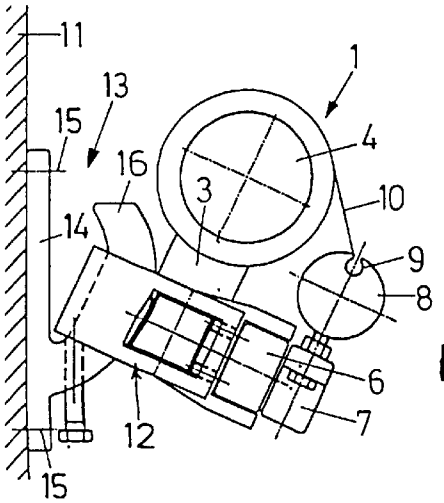
FIG. 2 is an illustration corresponding to FIG. 1 with the awning inclined.

FIGS. 1 and 2 as well as FIGS. 3 and 4 illustrate that in this suspended condition, the inside of the support bar 2 comes to bear against the outside of the holding section 16 of the fastening brackets 13.

Due to the curvature of the holding section 16 of the fastening brackets 13, the necessary distance between the bottom 22 of the U formed by each support-bar holder 12 and the inside of the support bar 2 is maximum in the horizontal condition of the joint alms 5 and decreases progressively while the angle of inclination or grows (cf. FIGS. 1 and 2 on the one hand and FIGS. 3 and 4 on the other). The angle $\alpha$ is the angle between a horizontal plane perpendicular to the support wall 11 and a plane through joint arms 5. Since this distance can be adjusted in effect by means of the screws 21 which act on the outside of the support bar 2, a desired angle of inclination or can be set in this way and fixed by means of the screws 21. Definite stabilization in the set condition is attained by the stop screws 18 being tightened.

What is claimed is:

1. An awning support for mounting an awning on a a surface, the awning support comprising:

fastening brackets each of which have a fastening section mountable to the surface and a holding section spaced apart from the fastening section;

a support bar (2);

a fabric roll shaft (4) mounted on said support bar (2) with the axes of the support bar and the fabric roll shaft (4) being substantially parallel;

joint arms (5) fixed on said support bar (2);

said joint arms extending the awning off of said fabric roll shaft;

said support bar (2) being slidably engaged in a U-shaped support bar holder (12);

said U-shaped support bar holder (12) being engageable between said holding section and said fastening section;

adjustment means on said U-shaped support bar holder for clamping said holding section between said support bar (2) and said holding section (16) to permit selection of an angle of inclination of the awning between a plane perpendicular to the surface and a plane through said joint arms.

2. The awning support according to claim 1, wherein the holding section has a threaded hole (17) and a stop screw (18) threaded therein to contact a bottom (22) of the U-shaped support bar holder (12) to further fix a selected angle of inclination of the awning.

3. The awning support according to claim 1, wherein the holding section is arcuate.

4. The awning support according to claim 3, wherein the holding section is curved away from a first end thereof fixed to the fastening section (14) and back towards the fastening section at a second free end.

5. The awning support according to claim 1, wherein the angle of inclination is fixable at a set angle.

6. The awning support according to claim 5 wherein a side of the support bar contacts the holding section when clamped thereto.

7. The awning support according to claim 6, wherein the adjustment means for clamping the support bar to the holding section are screws (21) actuatable from an outer side of the support bar holder to slide said support bar against said holding section.

* * * * *